US008079485B2

(12) United States Patent
Berndt

(10) Patent No.: US 8,079,485 B2
(45) Date of Patent: Dec. 20, 2011

(54) CLOSURE WITH PERFORATING FEATURE FOR CONTAINER SEALS

(76) Inventor: Brad Scott Berndt, Findlay, OH (US)

( * ) Notice: Subject to any disclaimer, the term of this patent is extended or adjusted under 35 U.S.C. 154(b) by 509 days.

(21) Appl. No.: 12/228,916

(22) Filed: Aug. 18, 2008

(65) Prior Publication Data

US 2010/0038338 A1 Feb. 18, 2010

(51) Int. Cl.
*B65D 39/00* (2006.01)

(52) U.S. Cl. ..... 215/257; 215/215; 215/295; 215/303; 215/212

(58) Field of Classification Search ..... 220/278, 220/212, 267, 277, 257, 379, 713; 215/257, 215/228, 250, 254, 255, 215, 226, 295, 303; 221/30, 31, 32; 222/80, 81, 541.2
See application file for complete search history.

(56) References Cited

U.S. PATENT DOCUMENTS 4,204,604 A 5/1980 Morin et al.
4,634,013 A 1/1987 Bar-Kokhba
4,678,098 A 7/1987 Oka
4,709,822 A 12/1987 Vataru
5,090,582 A 2/1992 Art et al.
5,148,937 A * 9/1992 Huard ..... 220/278
5,150,802 A 9/1992 Jeffers
5,505,326 A 4/1996 Junko
5,791,505 A 8/1998 Gilliland
5,797,506 A 8/1998 Lehmkuhl et al.
6,024,234 A 2/2000 Rink et al.
6,039,198 A 3/2000 Wolfe et al.
6,089,391 A 7/2000 Abelbeck et al.
6,182,845 B1 2/2001 Wolfe et al.
7,175,043 B2 2/2007 O'Neal
7,337,921 B2 3/2008 Ma

* cited by examiner

*Primary Examiner* — Mickey Yu
*Assistant Examiner* — Kareen Rush
(74) *Attorney, Agent, or Firm* — Hudak, Shunk & Farine Co. LPA

(57) ABSTRACT

A closure for sealing a container, in particular a container that, prior to first use by a consumer, includes an opening or aperture covered by a seal, wherein the closure is equipped with a perforating member adapted to open or break the seal, thereby enabling the consumer to access the contents of the container.

17 Claims, 1 Drawing Sheet

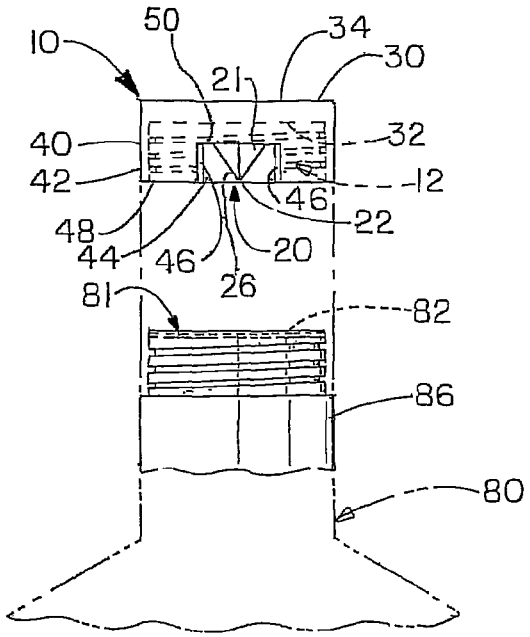
FIG.-1A
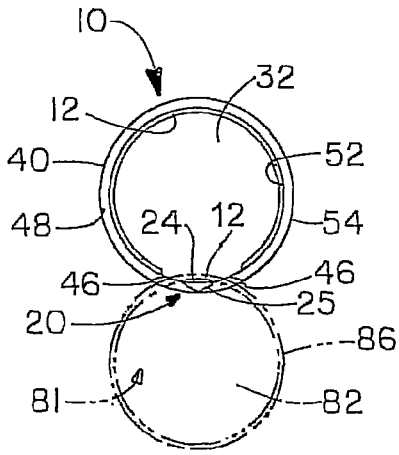
FIG.-1B
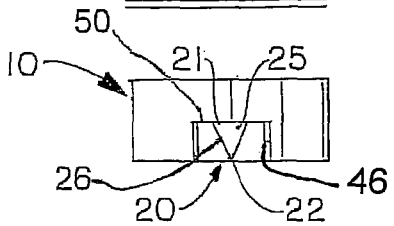
FIG.-2A
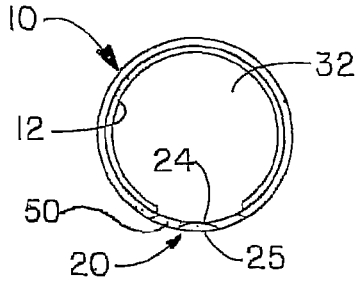
FIG.-2B
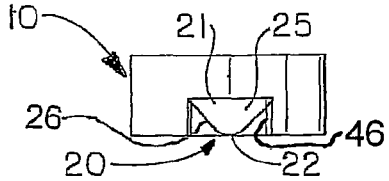
FIG.-3
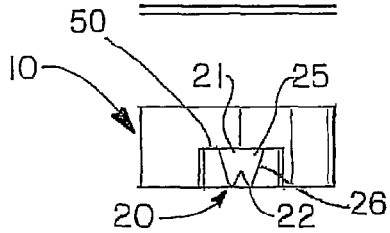
FIG.-4
FIG.-5
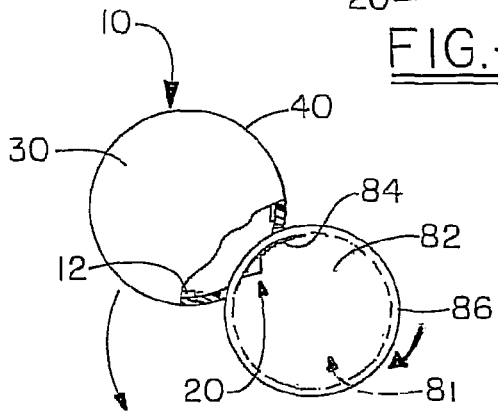

CLOSURE WITH PERFORATING FEATURE FOR CONTAINER SEALS

FIELD OF THE INVENTION

The present invention relates to a closure for sealing a container, in particular a container that, prior to first use by a consumer, includes an opening or aperture covered by a seal, wherein the closure is equipped with a perforating member adapted to open or break the seal, thereby enabling the consumer to access the contents of the container.

BACKGROUND OF THE INVENTION

Many different products are stored in containers such as bottles, cans, or the like having a closure that can be screwed and/or snapped onto the container and closes the opening in the container. In order to provide assurance to the consumer that the contents of the container have not been tampered with between production and receipt by the consumer or that the contents are fresh, or the like, the container opening is provided with a seal. Examples of seals include, but are not limited to, laminate or foil seals made from one or more of, for example, metals, polymers and cellulosic materials.

U.S. Pat. No. 4,204,604 relates to improving a closure system for containers in which a cap member sealed at its base to an annular flange about the neck of the container is removable by a cutting ring. The cap includes an upwardly projecting brim at the base separated from the sidewall of the cap to reportedly provide an annular groove. The groove has at least one tapered recess. The cutting ring, which can be positioned around the sidewall of the cap, has at least one depending tab with an inwardly directed sharpened projection. The tab rests in the recess of the groove. Upon rotation of the cutting ring, the tab is forced inwardly reportedly causing the sharpened projection to sever the sidewall of the closure.

U.S. Pat. No. 4,634,013 relates to a closing and opening device for a bottle with an opening sealed by a membrane comprising a cap adapted to engage the opening of the bottle for closing the same, a cutting device for cutting the membrane of the bottle connected to the cap, and a device to reportedly allow rotation of the cap less than 360° relative to the opening of the bottle while the cutting device is in engagement with the membrane, so that the membrane is cut less than 360 degrees to prevent the membrane being cut from detaching from the bottle.

U.S. Pat. No. 4,678,098 relates to a fastening structure of a tube and cap assembly. The structure includes an unthreaded part formed in the threaded portion of cap or of a mouth member of a tube. The unthreaded part reportedly acts as a stopper to keep the cap being secured to the mouth member of the tube, but if the cap is forcibly screwed further, the unthreaded part is rolled and deformed by the other threaded portion which does not include the unthreaded part to form threads on the unthreaded part. Due to this forcible action, a conical cutting edge, if it is provided on the inner bottom surface of cap, is pressed against the sealed mouth of tube to reportedly break the sealed mouth.

U.S. Pat. No. 4,709,822 relates to a bottle neck and cap combination, wherein threads formed on its outer side and there being structure at the uppermost end of the neck to close same, the cap having a first skirt and threading formed on the skirt at the inner side thereof to mesh with the neck threads when the cap is rotatably attached to the neck. In this environment, there is provided: (a) first lug structure including a first lug on the neck and protruding sidewardly outwardly thereof, (b) a second lug on the cap skirt and protruding sidewardly inwardly thereof to engage and ride over the first lug during rotatable attachment of the cap to the neck, and (c) a brake surface formed on the cap generally opposite the second lug and presented inwardly to reportedly engage the neck and frictionally resist cap rotation in either direction after the second lug rides over the first lug in a cap tightening direction.

U.S. Pat. No. 5,090,582 relates to a bottle cap reportedly having a cutting means located inside the cap for selectively opening a sealed bottle. The cap reportedly can be rotated in either direction over the seal to cause the seal to be punctured and to cause a "C"-shaped cut in the seal. In the preferred embodiment, the center of the "C"-shaped cut portion of the seal is reportedly dragged away from the center of the mouth of the bottle, and a portion of the liner remains uncut as the cap is rotated to prevent the liner from dropping down into the bottle.

U.S. Pat. No. 5,148,937 relates to a cap for use on a container having a neck defining an opening sealed by a protective foil that has to be removed when the container is used for the very first time. The cap comprises a top sized to close the opening and a peripheral skirt that projects from the top and is detachably connectable to the wall of the neck. The cap also comprises at least one and preferably two open slots made in the skirt, the slots extending at an angle from the bottom edge of the slot and being wide engage to receive the wall of the neck. The slots are made in the skirt to define spikes that preferably are oppositely oriented for use by right-handed or left-handed persons to reportedly perforate and remove the protective foil sealing the neck of the container when the latter has to be opened for the very first time.

U.S. Pat. No. 5,505,326 relates to a closure device for a container having an opening sealed with a membrane and comprising a cap adapted to engage the opening of the container for closing same and comprising a first cylindrical wall connected to one side of a circular base, and a reportedly membrane-penetrating element comprising a second cylindrical wall connected to the reverse side of the circular base and, within the second cylindrical wall, means for penetrating a membrane when the element is pressed into contact with the opening of a container sealed with the membrane, the means comprising a plurality of arciform cutters that are connected to the base and are coaxial with and in close proximity to the inner surface of the second cylindrical wall, the plurality of arciform cutters together comprising a total of at least 300°.

U.S. Pat. No. 5,791,505 relates to a cap for pill bottles and like medicinal containers normally having cotton wadding therein between the pills or capsules and the open mouth of the bottle, wherein the cap is reportedly provided with an external hook member which is positionable to be inserted into the bottle to easily remove the cotton without flexing or forcing the fingers into the small mouth bottle.

U.S. Pat. No. 5,797,506 relates to a closure for sealing a container having an opening covered by a seal. The closure includes a peripheral wall and a nub extending upwardly from the top of the cap. The nub is radiused and includes a rounded peripheral edge. The nub also includes a planar outer surface facing the peripheral wall. The size, location and geometric shape of the nub are reportedly selected so that when the closure is inverted, placed over the opening, and rotated 360 degrees or more, the nub will reportedly tear the seal only partially away from the container.

U.S. Pat. No. 6,024,234 is related to a cap member having an annular wall and a top wall disposed within and connected to the annular wall. An arcuate pierce-plow member is disposed on an upper surface of the top wall at a position spaced from the annular wall. The pierce-plow member includes a first plow base member having a ramp portion and a substantially flat portion. The pierce-plow member further includes a piercing member disposed adjacent to the substantially flat portion of the plow base member. The piercing member includes a first portion disposed adjacent to the first plow base member and a second portion disposed at a position spaced from the first plow base member. A thickness of the second portion of the piercing member is greater than a thickness of the first portion of the piercing member.

U.S. Pat. No. 6,039,198 relates to a cut and pierce closure molded from a rigid plastic material for a container whose open mouth is normally sealed by a thin membrane applied to a rim of the container. The closure is removably applied to the container in a closing orientation by inter-engaging helical threads on the exterior of a neck of the container and an annular skirt of the closure. To dispense the contents of the container, the closure is removed and reapplied in an inverted orientation, a flange extension of the closure skirt surrounding the rim of the container and serving to center the closure in its inverted orientation on the container. A top panel of the closure is provided with a double-ended arcuate shoulder that reportedly engages the membrane when the closure is in its inverted orientation on the container to maintain tension in the portion of the membrane in engagement with the shoulder. The arcuate shoulder also serves, in combination with the flange extension, to trap the rim of the container therebetween. A sharp cutting element projects axially from the shoulder at a location between its ends and functions to pierce the membrane when the closure is reapplied, in its inverted orientation, to the container. When the closure is rotated on the container in the inverted orientation, the cutting element will cut the membrane along an arc of less than 360°, even if the closure is rotated 360° or more, to thereby permit dispensing of the contents of the container after removal of the closure from the container while ensuring that the severed membrane remains affixed to the rim of the container without dropping into the contents of the container.

U.S. Pat. No. 6,089,391 relates to a novel container cap and containment system which includes a cap with an upper and a lower portion, reportedly being removable one from the other. The upper portion has an upper wall that is continuous with an outer rim. The outer rim is constructed such that it fits over the orifice of a container. A blade is included inside of the peripheral edge of the outer rim and preferably extends from the upper wall. The blade, in one embodiment, is preferably oriented in a "C" shape, whereby the cap can be removed from the container and the upper portion oriented over the orifice and depressed therein, thus reportedly cutting the safety seal while allowing a small portion to remain, thereby preventing the cut seal from falling into the container.

U.S. Pat. No. 6,182,845 relates to a cut and pierce closure molded from a rigid plastic material for a container whose open mouth is normally sealed by a thin membrane applied to a rim of the container. The closure is removably applied to the container in a closing orientation by inter-engaging helical threads on the exterior of a neck of the container and an annular skirt of the closure.

U.S. Pat. No. 7,175,043 relates to a disposable lid for beverage containers which includes a mechanism reportedly enabling a user to hang the lid on the rim of the container, rather than placing the lid on a counter or table top, to avoid actual or perceived unsanitary conditions and to minimize risk of transmitting infectious diseases to the user.

U.S. Pat. No. 7,337,921 relates to a closure for a container having an opening which includes a base cap and an overcap that form a sealed chamber adjacent the opening that is isolated from the contents of the container. The base cap includes an outer skirt having container-engaging structure, a cylindrical well, a frangible membrane connected to the well along an inclined line of weakness and by a hinge member. The hinge member includes a pocket extending downward adjacent lower and upper terminuses of the line of weakness. The overcap includes a body having a gripping structure, an inner skirt received within and rotatably connected to the well, and a cutting member depending from a lower end of the inner skirt received within the pocket such that the cutting member extends below the upper terminus. The cutting member reportedly severs the line of weakness upon substantial rotation of the overcap with respect to the base cap.

In view of the above, there is still a need for a closure for a container incorporated with a feature that allows a consumer to penetrate or perforate, and subsequently remove a seal in an aperture of the container prior to first use of the contents within the container, wherein the closure is able to be produced with a relatively small cost increase or no increase when compared to a corresponding closure not having the seal opening feature.

SUMMARY OF THE INVENTION

An object of the invention is to provide a closure provided with a feature to assist an individual in the opening of a container having a seal covering an aperture in the container.

A further object of the invention is to provide a closure having an integral perforating member located on the periphery of the closure that is adapted to perforate, cut or puncture a seal of a container, wherein the closure maintains the ability to operate normally without interference from the perforating member.

Still another object of the invention is to provide a closure with a perforating member, wherein the closure does not require any additional components in order to open the seal on a container.

Yet another object of the invention is to provide a versatile closure for opening a seal that can be used by both left- and right-handed individuals that is aesthetically pleasing to the eye.

Another object of the present invention is to provide a closure incorporating a perforating member that is easy to use and able to create an opening in a container seal of a desired size to allow access to the contents of the container.

Still another object of the invention is to provide a closure that has the ability to open a container seal and maintain the ability to seal the container after use.

Yet another object of the invention is to provide a closure with a perforating member that can be used to selectively open a portion of a container seal so that a portion of the seal can remain attached to the container and be manually removed without the seal falling into the container aperture.

A further object of the invention is to provide a closure having a perforating member that is simple and economical to produce when compared to a similar closure without the perforating member.

Another object of the present invention is to provide a closure having a sidewall extending from a top wall, wherein the sidewall along the portion of periphery thereof includes a perforating member for use in perforating a container seal.

In one aspect of the invention, a closure for a container is disclosed, comprising a top wall having a substantially circular form, the top wall having an inner surface and an outer surface, a substantially annular sidewall connected to the top wall and extending downwardly a distance from the top wall and having a bottom edge and a periphery, wherein the sidewall comprises an aperture extending a distance along a portion of at least the bottom edge, the aperture having a first sidewall and a second sidewall each having a height measured from the bottom edge and connected by an upper wall, the upper wall having a downwardly extending perforating member adapted for opening a seal of a container, located in an annular footprint of the sidewall measured between a sidewall inner surface and outer surface, and wherein the perforating member has one or more lower ends terminating at a height at or above the bottom edge of the sidewall.

In another aspect of the present invention, a closure for a container is disclosed, comprising a top wall having an inner surface and an outer surface and a sidewall extending downwardly a distance from the top wall and surrounding the top wall inner surface, the sidewall having a periphery and a bottom edge, the sidewall including an aperture comprising first and second aperture sidewalls each connected to the bottom edge, wherein the closure further includes a perforating member adapted for opening a seal on a container and connected to one or more of an upper wall extending between the first and second aperture sidewalls and the first and second aperture sidewalls, the perforating member having an upper end and a lower end, the perforating member lower end terminating at a vertical height at or above the bottom edge of the sidewall, the perforating member located within the periphery of the sidewall.

BRIEF DESCRIPTION OF THE DRAWINGS

The invention will be better understood and other features and advantages will become apparent by reading the detailed description of the invention, taken together with the drawings, wherein:

FIGS. 1A and 1B represent a side elevational view and a bottom view, respectively, of one embodiment of a closure for a container having a perforating member in the annular sidewall of the closure;

FIGS. 2A and 2B represent a side elevational view and a bottom view, respectively, of one embodiment of a closure for a container having a perforating member in the annular sidewall of the closure;

FIG. 3 is a side elevational view of a further embodiment of a closure having a perforating member with a rounded lower end according to the present invention;

FIG. 4 is a side elevational view of a further embodiment of a closure having a perforating member having two lower perforating ends according to the present invention; and FIG. 5 is a partial cross-sectional top view particularly illustrating a closure of the present invention opening a seal of a container.

DETAILED DESCRIPTION OF THE INVENTION

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Referring now to the drawings, FIGS. 1A and 1B illustrate a closure 10 for a container 80, having an aperture 81 for adding or removing goods for storage within the container 80, wherein the aperture 81, in the illustration is located on the neck 86 of container 80, and is initially closed by a seal 82 covering the aperture 81.

The closure 10 is generally in the form of a cap, top, or lid, generally cylindrical, that can be operatively connected to the container 80 to seal the opening or aperture of the container. The closure 10 can also be utilized to open or rupture a seal 82 initially present on the container to provide for evidence of a factory seal, notice that the contents have not been tampered with, and/or evidence of an air tight barrier, for example.

The closure 10 includes a top end or wall 30 that is substantially circular or disc-shaped and sized to cover the end of a corresponding container 80. The top wall 30 includes an inner surface 32 and outer surface 34. A sidewall 40 extends downwardly from the top wall 30, preferably from the periphery of the top wall 30, and preferably substantially vertically, such as shown in FIG. 1A. The sidewall 40 is generally annular in shape and can be considered a skirt that is adapted to surround a portion of a container neck 86 when the closure 10 is installed on the container 80. The sidewall can also be described as having a hollow cylindrical form having a periphery 42.

The sidewall 40 has a bottom edge 48 that is interrupted in at least one segment by a sidewall aperture 44 that contains one or more perforating members 20. The sidewall aperture 44 extends a desired distance along the circumference of the sidewall annulus or periphery 42. The sidewall aperture 44 has aperture sidewalls 46 and allows a portion of the closure 10 to be placed over the container aperture 81 to perforate seal 82. That is, the sidewall aperture 44 is large enough that a portion of the container 80, generally neck 86 can be disposed between a portion of perforating member 20 or a portion of aperture sidewalls 46, whereby the perforating member 20 is able to perforate a portion of seal 82, see FIG. 5 for example.

Each aperture sidewall 46 is connected to an upper wall 50, see FIGS. 1A, 2A and 4, or directly to a portion of the perforating member 20, see FIG. 3 for example. In the case where the upper wall is connected to the aperture sidewall 46, the perforating member 20 extends downwardly and inwardly from aperture sidewall 46 and has a lower end 22 that terminates at a height at or above the bottom edge 48 of sidewall 40. The aperture sidewalls 46 are separated on the circumference of the sidewall 40 a sufficient distance such that the perforating member 20 radially therebetween can pierce the seal within the inner diameter of the associated container. Therefore, in one embodiment, the angle between the imaginary lines extending between the radial center point of the closure 10 and adjacent aperture sidewalls 46 present on the sidewall of the closure ranges generally from about 30° to about 60°, desirably from about 35° to about 55°, and preferably from about 40° to about 50°. The distance between adjacent aperture sidewalls 46 measured circumferentially along the sidewall annulus, i.e., periphery 42, is generally about 8% to about 20% or less than 50%, and preferably about 13% to about 14% or about 17% of the periphery. While larger distances between adjacent aperture sidewalls can be utilized, there may be difficulty in threading the closure onto the container or the design may be found unattractive by some consumers.

The form and location of the perforating member 20 is important for proper functioning of the closure 10. The characteristics of the perforating member 20 can vary by application and can depend on characteristics of the particular seal 82 utilized to seal the container 80 and the various dimensions of the container, such as the configuration of container neck 86. Perforating member 20 is located in the annular footprint of the sidewall, as illustrated in FIGS. 1B and 2B. Perforating member 20 has a maximum vertical height measured from the upper end 21 adjacent either aperture sidewall 46 or upper wall 50 of closure 10 to lower end 22. The height of the perforating member 20 is sufficient such that the closure 10, when fitted over container 80 in a position such as shown in FIG. 5 in order to pierce a seal, has a sufficient length to perforate the seal when the closure 10 is drawn down over the container 80 to perform the seal piercing operation. That said, the maximum vertical height of the perforating member 20 measured from the upper end 21 to lower end 22 is generally from about 0.5 to about 10 mm, desirably from about 2.5 to about 8.5 mm, and preferably from about 4 to about 7 mm.

Sidewall 40 of closure 10 has a maximum length measured between top wall 30 and sidewall bottom edge 48, as measured perpendicular to the plane of the bottom edge 48 and top wall 30 for a simple closure 10 as illustrated in FIG. 1. The maximum length of the perforating member 20 compared to the total length of the sidewall, i.e., for example vertical length as illustrated in FIG. 1, ranges generally from about 3% to about 67%, and preferably ranges from about 10% to about 50%.

The perforating member 20 also has an inner surface 24 and an outer surface 25, see FIGS. 1B and 2B. The inner surface 24 faces the interior of the closure 10 and the outer surface 25 likewise faces the exterior portion of the closure member and is thus exposed. The perforating member, including the inner surface 24 and outer surface 25, extending between the upper end 21 and lower end 22, can have any configuration and each, independently, can be linear or curved or a combination thereof along their respective lengths. Perforating member 20 is, in horizontal cross-section, as illustrated in FIG. 1B, angular along a portion of its length. That is, the outer surface 25 is angled and forms a point generally at a central location between the ends of the outer surface 25. Inner surface 24 has an arc or radius that substantially matches the arc or radius of the interior surface 52 of sidewall 40 and is preferred in one embodiment. Likewise, as illustrated in FIG. 2B, perforating member 20 is in horizontal cross-section, arcuate along a portion thereof, in this case having an arc or radius on outer surface 25 that matches the arc or radius of periphery 42, and inner surface 24 has an outwardly curved arc. Other horizontal cross-sectional configurations for portions of perforating member 20 along all or portions of its vertical length include, but are not limited to, square, rectangular, triangular and a portion of an annulus.

In one preferred embodiment of the present invention, the sidewall 26 of the perforating member 20 located between the upper end 21 and lower end 22 adjacent aperture sidewall 46 is disposed at a desired angle in order to provide for a desired perforation of the seal member 82 of container 80. In one embodiment, the angle between upper wall 50 and the sidewall 26 of perforating member 20 ranges generally from about 100° to about 160°, desirably from about 110° to about 145°, and preferably from about 120° to about 130°. An angle of approximately 125° is illustrated in FIG. 1A. An angle of about 120° is shown in FIG. 2A, and an angle of about 125° is illustrated in FIG. 4. When the perforating member 20 has a sidewall 26 connected directly to aperture sidewall 46, such as shown in FIG. 3, the angle therebetween ranges generally from about 20° to about 80°, desirably from about 25° to about 70°, and preferably from about 30° to about 50°. An angle of about 40° is illustrated in FIG. 3.

In a further embodiment of the invention, the closure 10 includes one or more threads 12 which are continuous or discontinuous segments, preferably helical overall, that can be interrupted by gaps of any desired spacing. In one embodiment, the threads 12 present on the inner surface 32 of closure 10 are located vertically above the area where perforating member 20 is located and, therefore, do not interfere with the perforating member 20, for example see the uppermost thread in FIG. 1A.

As illustrated in FIG. 1A, threads 12 can have a starting location laterally adjacent to perforating member 20 and extend above the perforating member 20. In FIG. 1B the thread segment 12 is formed on an inner surface 24 of the perforating member 20. Therefore, the perforating member 20 also aids in securing the closure 10 to the container 80. As the threads have a relatively small thickness, a thread located on the perforating member 20 does not substantially interfere with the perforating member's ability to pierce the seal 82.

The threads 12 are adapted to mate with threads or other complementary components on container 80 such that the closure 10 can be threadedly installed and removed by rotating the closure 10 with respect to the container 80.

The outer surface of the sidewall 40 can be ribbed or textured in a conventional manner to provide a non-slip gripping surface. Moreover, in a further embodiment of the present invention, the closure 10 can be threadless and thus removably attached to a container 80 in substantially any manner as known in the art.

Closure 10 is formed from any materials suitable to form a closure. Even though closure 10 has a relatively complex configuration, it can be formed of a single multiple piece construction. Multiple piece construction can be utilized, by way of non-limiting example, in a case where the closure is in the form of a child resistant closure. Closure 10, is desirably formed from a polymeric material, either thermoset or thermoplastic, preferably thermoplastic, such as a polyolefin, for example polyethylene or polypropylene. The closure can be formed by any suitable process, preferably a molding process, for example by injection molding.

The closure 10 functions to close the container 80 in a conventional manner. The closure 10 is positioned upright with its sidewall bottom edge positioned over the container aperture 81, preferably present in container neck 86. The closure 10 is then rotated, usually clockwise, and the closure threads 12 mate with corresponding threads or other components on container 80 causing the closure to be drawn down onto the neck 86, thereby covering aperture 81 and sealing the container 80. As the closure 10 is rotated, the inner surface 32 of top wall 30 where a liner optionally within the closure 10, not shown, or the inner surface 30 of top wall 30 engages the composition of the container around the aperture 81, thereby sealing container 80. In this manner, the closure 10 covers the aperture 81 and container 80 and prevents the contents from spilling. The closure 10 can be removed from the container 80 by reversing the indicated procedure.

Closure 10 also functions to rupture, perforate or tear the seal 82 of container 80 so it can be more easily removed from the container 80 by hand. To rupture the seal 82, the closure 10 is removed from the container 80 in a conventional manner, such as by rotating it in a counterclockwise direction. Once the closure 10 is removed from the container 80, the closure is positioned such that the perforating member 20 is located above seal 82 with the lower end 22 pointed downwardly at the seal 82. The sidewall aperture is positioned above the portion of the container 80 adjacent seal 82. Closure 10 is then pushed down onto the container 80 with the perforating member 20 engaging seal 82. As the closure 10 is pushed down, the lower end 22 punctures the seal 82. Once the seal 82 is punctured, the closure 10 can be rotated to form a perforated area 84, such as illustrated in FIG. 5. As the closure 10 or container 80 is rotated, the perforating member sidewall 26 cuts through seal 82 in the path of the sidewall 26. At this point, the seal 82 is still held by its remaining attachment to a portion of the container 80. The closure 10 or container 80 can be rotated in either a clockwise or a counterclockwise direction to affect a desired length of a tear of perforated area 84. As the closure 10 is rotated, the perforated area 84 progresses around the periphery of the seal 82 and the seal 82 is increasingly separated from the container 80. Once the closure 10 is rotated far enough to form a tear around a desired area of seal 82, the closure 10 can be removed and the seal 82 can be further manually removed.

In accordance with the patent statutes, the best mode and preferred embodiment have been set forth; the scope of the invention is not limited thereto, but rather by the scope of the attached claims.

What is claimed is:

1. A closure for a container, comprising:

a top wall having a substantially circular form, the top wall having an inner surface and an outer surface;

a substantially annular sidewall connected to the top wall and extending downwardly a distance from the top wall and having a bottom edge and a periphery, wherein the sidewall comprises an aperture extending a distance along a portion of at least the bottom edge, the aperture having a first sidewall and a second sidewall connected by an upper wall, the first aperture sidewall and second aperture sidewall each having a height measured from the bottom edge to the upper wall, the upper wall having a downwardly extending perforating member adapted for opening a seal of a container, located in an annular footprint of the sidewall measured between a sidewall inner surface and outer surface, wherein the perforating member is located between the first aperture sidewall and the second aperture sidewall, and wherein the perforating member has one or more lower ends terminating at a height at or above the bottom edge of the sidewall, wherein the inner surface of the sidewall contains a thread, wherein a portion of the thread is located between the upper wall of the aperture and the top wall, and wherein a portion of the thread is located on an inner surface of the perforating member.

2. The closure according to claim 1, wherein the perforating member has an angular horizontal cross-section along a portion of an inner surface or an outer surface, or a combination thereof.

3. The closure according to claim 1, wherein the perforating member has a substantially arcuate horizontal cross-section along a portion of an inner surface or an outer surface, or a combination thereof.

4. The closure according to claim 3, wherein the perforating member outer surface has a substantially arcuate horizontal cross section along a portion of its length, and wherein the arcuate horizontal cross section has a radius equal to a radius of the outer surface of the annular sidewall measured in relation to an axis extending through a center of the closure.

5. The closure according to claim 4, wherein the perforating member inner surface has a substantially arcuate horizontal cross section along a portion of its length, and wherein the inner surface arcuate horizontal cross section has a radius equal to the radius of the inner surface of the annular sidewall measured in relation to an axis extending through a center of the closure.

6. The closure according to claim 1, wherein the sidewall aperture is from about 8 percent to about 20 percent of a circumference of the bottom edge of the annular sidewall.

7. The closure according to claim 6, wherein the perforating member has a maximum height of about 10 percent to about 50 percent based upon a maximum height of the sidewall.

8. The closure according to claim 1, wherein an angle between the perforating member sidewall and the upper wall is from about 100° to about 160°.

9. The closure according to claim 1, wherein the perforating member includes two or more lower ends.

10. The closure according to claim 1, wherein the perforating member has a section connected directly to the aperture sidewall, and wherein an angle between the aperture sidewall and the section of the perforating member is between about 20° to about 80°.

11. The closure according to claim 1, wherein the annular sidewall has multiple apertures extending a distance along a portion of at least the bottom edge.

12. A closure for a container, comprising:

a top wall having an inner surface and an outer surface and a sidewall extending downwardly a distance from the top wall and surrounding the top wall inner surface, the sidewall having a periphery and a bottom edge, the sidewall including an aperture comprising first and second aperture sidewalls each connected to the bottom edge, wherein the closure further includes a perforating member adapted for opening a seal on a container and connected to one or more of an upper wall extending between the first and second aperture sidewalls and the first and second aperture sidewalls, the perforating member having an upper end and a lower end, the perforating member lower end terminating at a vertical height at or above the bottom edge of the sidewall, the perforating member located within the periphery of the sidewall between the first and second aperture sidewalls, wherein the sidewall contains a thread and wherein a portion of thread is located on an inner surface of the perforating member.

13. The closure according to claim 12, wherein the sidewall is substantially annular and has an inner surface and an outer surface, each having the radius with the inner surface radius being smaller than the outer surface radius, and wherein the perforating member is located at a radial distance greater than or equal to the radius of the sidewall inner surface and less than or equal to the radius of the sidewall outer surface.

14. The closure according to claim 13, wherein the perforating member has an inner surface and an outer surface, wherein the outer surface has a substantially arcuate horizontal cross section along a portion of its length, wherein the arcuate horizontal cross section, has a radius equal to a radius of the outer surface of the annular sidewall, wherein the perforating member inner surface has a substantially arcuate horizontal cross section along a portion of its length, and wherein the inner surface arcuate horizontal cross section has a radius equal to the radius of the inner surface of the annular sidewall measured in relation to an axis extending through a center of the closure.

15. The closure according to claim 13, wherein the sidewall aperture is from about 8 percent to less than 50 percent of a circumference of the bottom edge of the annular sidewall, wherein the perforating member has a maximum height of about 3 percent to about 67 percent based upon a maximum height of the sidewall, and wherein an angle between the perforating member sidewall and the upper wall is from about 100° to about 160°.

16. The closure according to claim 13, wherein the perforating member has a section connected directly to the aperture sidewall, wherein the sidewall aperture is from about 8 percent to about 20 percent of the circumference of the bottom edge of the annular sidewall, and wherein an angle between the aperture sidewall and the section of the perforating member is between about 20° to about 80°.

17. The closure according to claim 15, wherein the sidewall aperture is from about 8 percent to about 20 percent of the circumference of the bottom edge of annular sidewall, wherein the maximum height of the perforating member is about 10 percent to about 50 percent of the maximum height of the sidewall, wherein the angle between the perforating member sidewall and the upper wall is from about 110° to about 145°, and wherein the closure includes a thread segment on a section of the sidewall located between the perforating member and an area of connection of the sidewall to the top wall.

* * * * *